US006668409B1

(12) United States Patent
Blumer

(10) Patent No.: US 6,668,409 B1
(45) Date of Patent: Dec. 30, 2003

(54) CONVOLUTED FOAM FUTON MATTRESS

(75) Inventor: Mathew E. Blumer, Elk Mound, WI (US)

(73) Assignee: August Lotz Co., Inc., Boyd, WI (US)

( * ) Notice: Subject to any disclaimer, the term of this patent is extended or adjusted under 35 U.S.C. 154(b) by 0 days.

(21) Appl. No.: 10/147,747

(22) Filed: May 16, 2002

(51) Int. Cl.[7] ..... A47C 27/22; A47C 27/15
(52) U.S. Cl. ..... 5/740; 5/736; 5/690; 5/953
(58) Field of Search ..... 5/736, 690, 691, 5/731, 740, 655.9, 944, 953

(56) References Cited

U.S. PATENT DOCUMENTS

| | | | | | |
|---|---|---|---|---|---|
| 2,830,306 | A | | 4/1958 | Wagner et al. | 5/351 |
| 4,207,636 | A | * | 6/1980 | Ceriani | 5/740 X |
| 4,276,666 | A | * | 7/1981 | Yamada | 5/736 |
| 4,316,298 | A | * | 2/1982 | Russo et al. | 5/722 |
| 4,955,095 | A | * | 9/1990 | Gerrick | 5/691 |
| 4,985,951 | A | | 1/1991 | Lacotte et al. | 5/465 |
| 5,319,814 | A | * | 6/1994 | Dyer, Jr. | 5/736 X |
| 5,367,727 | A | * | 11/1994 | Dyer, Jr. | 5/736 X |
| 5,488,746 | A | * | 2/1996 | Hudson | 5/691 X |
| 5,636,397 | A | * | 6/1997 | Boyd et al. | 5/740 X |
| 5,657,500 | A | | 8/1997 | Messina | 5/722 |
| 5,669,094 | A | | 9/1997 | Swanson | 5/740 |
| 5,953,778 | A | | 9/1999 | Hiatt | 5/716 |
| 6,052,851 | A | | 4/2000 | Kohnle | 5/690 |
| 6,237,173 | B1 | | 5/2001 | Schlichter et al. | 5/722 |

* cited by examiner

*Primary Examiner*—Robert G. Santos
(74) *Attorney, Agent, or Firm*—Andrus, Sceales, Starke & Sawall, LLP

(57) ABSTRACT

A futon mattress has a first support component formed from fabric batting, a second support component formed from convoluted foam and a separation layer interposed between the first support component and the second support component for preventing the migration of the fiber batting into the convoluted foam.

7 Claims, 5 Drawing Sheets

FIG. 3
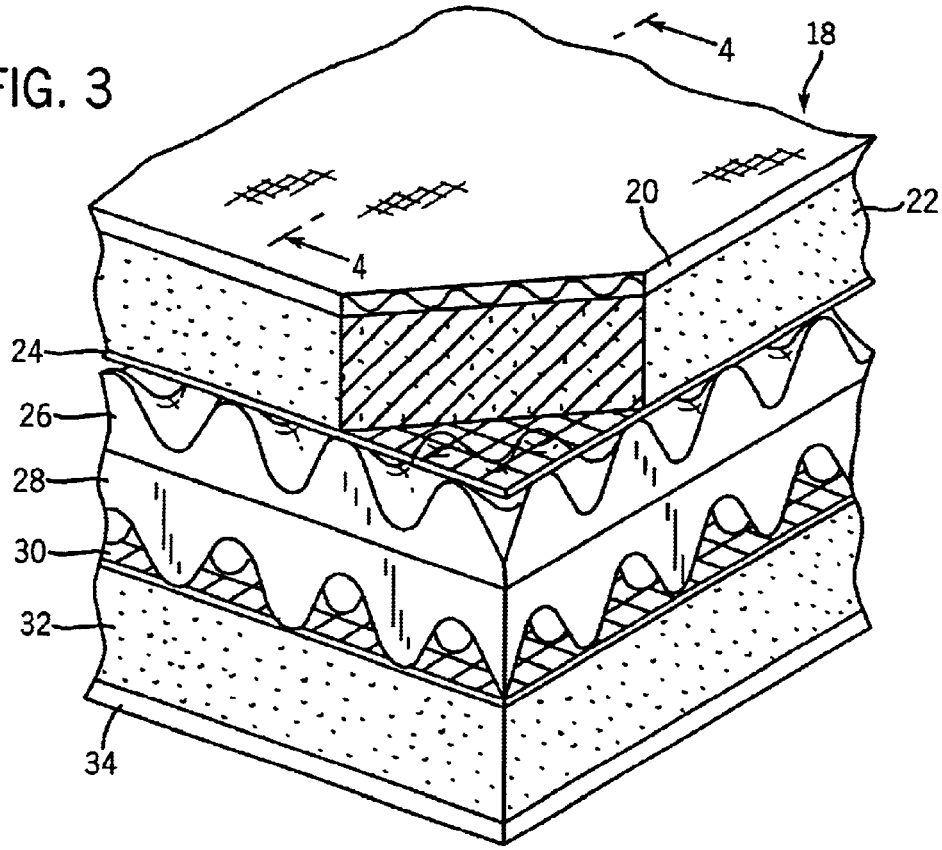
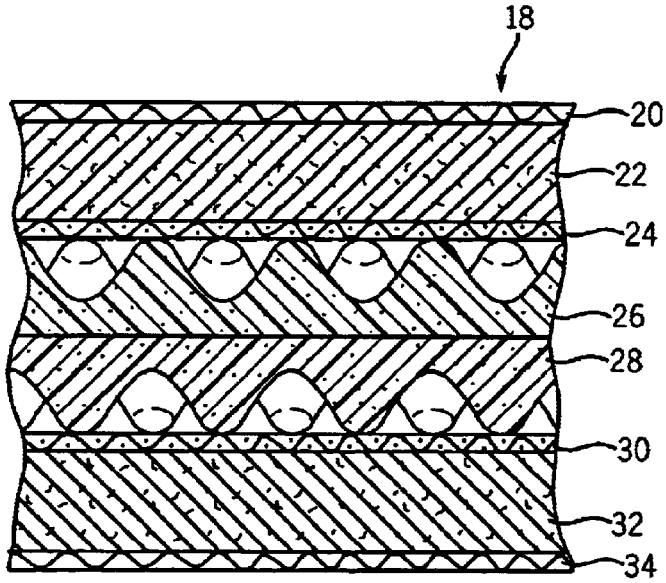
FIG. 4

CONVOLUTED FOAM FUTON MATTRESS

FIELD OF THE INVENTION

The present invention relates generally to a mattress for use in connection with convertible furniture, such as futons. More specifically, the present invention pertains to a futon wherein mattress components are held spaced apart from one another to maintain the ability of the mattress to support weight and retain resiliency.

BACKGROUND OF THE INVENTION

In presently available convertible furniture, such as futons, the furniture includes a frame that is movable between an upright, seating position and a horizontal, sleeping position. The convertible furniture includes a mattress enclosed within a decorative covering that is placed on the furniture frame and acts as a cushion for the seat and back when the convertible furniture is in the upright position and functions as a mattress when the convertible furniture is in the horizontal, sleeping position.

Currently, the most common types of futon mattresses are formed from either cotton or wool batting or foam, or a combination thereof, to provide the required cushioning when the mattress is positioned in either the upright position or the sleeping position. Currently, futon mattresses having a foam core, such as fabricated from convoluted foam, are the most popular due to their light weight and superior cushioning capabilities.

When convoluted foam is used in current futon mattress designs, it is usually interposed between layers of fiber batting. The problem with this design is that as the futon mattress is used, the fiber batting migrates into the convolutions of the foam which effectively reduces the ability of the mattress to support weight and retain resiliency. It is the tendency of the fiber batting to migrate that makes futon mattresses with convoluted foam in their construction perform poorly for retained loft, retained resiliency, and body impression over time.

Accordingly, a need exists for a convertible furniture mattress that maintains separation between its fiber batting and convoluted foam layers in order to optimize the abilities of the foam to be supportive and resilient over time. There is also a need to select a material which will provide the desired separation between the fiber batting and convoluted foam layers as well as create different feels in the finished futon mattress.

SUMMARY OF THE INVENTION

It is a general object of the present invention to provide a futon mattress having cushioning which maintains a high degree of comfort and support over time.

It is also an object of the present invention to provide a futon mattress wherein fiber batting components are prevented from migrating into convolutions of foam components forming a core of the mattress.

It is a further object of the present invention to provide a futon mattress employing a separating layer or material interposed between cushioning components for optimizing the comfort factor of the mattress.

In one aspect of the invention, a futon mattress includes a first support component formed from fiber batting. A second support component is formed from convoluted foam. A separation layer is interposed between the first support component and the second support component for preventing the migration of the fiber batting into the convoluted foam. The fiber batting component includes a protective, decorative fabric material on an external surface thereof. The separation layer is comprised of a flexible, foraminous material, such as polypropylene netting.

In another aspect of the invention, a futon mattress includes an upper protective, decorative fabric material, and an upper fiber batting layer disposed adjacent to the upper protective, decorative fabric material. An upper flexible netting material is disposed adjacent to the upper fiber batting layer. An upper convoluted foam layer is disposed adjacent to the upper netting material. A lower convoluted foam layer is disposed adjacent to the upper convoluted foam layer. A lower fiber batting layer is disposed adjacent to the lower netting material. The lower protective, decorative fabric is disposed adjacent to the lower fiber batting layer. With this construction, the layers of netting material prevent the migration of the fiber batting layers into the convoluted foam layers thereby optimizing the ability of the convoluted foam layers to be supportive and resilient. The fiber batting layers, the netting layers and the convoluted foam layers are encased in a sleeve formed by the protective, decorative fabric materials.

Various other objects, features and advantages of the invention will be made apparent from the following description taken together with the drawings.

BRIEF DESCRIPTION OF THE DRAWINGS

The drawings illustrate the best mode presently contemplated of carrying out the invention.

In the drawings:

FIG. 3 is a fragmentary, perspective view of the components of the mattress in an assembled state;

FIG. 4 is a sectional view taken on line 4—4 of FIG. 3;

DETAILED DESCRIPTION OF THE INVENTION

Figure 1:
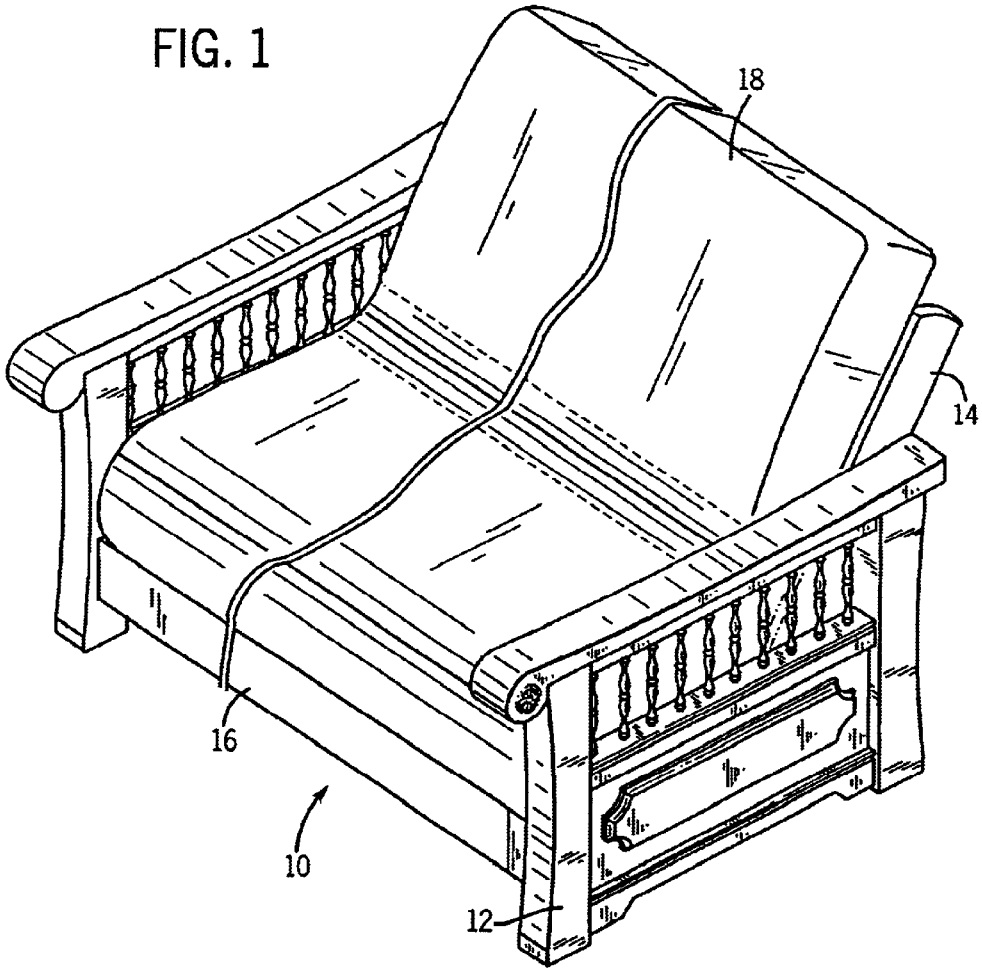
FIG. 1 is a perspective view of a piece of convertible furniture having a mattress embodying the present invention.

FIG. 1 illustrates a piece of convertible furniture 10 having a frame consisting of a pair of side arms 12, a back 14 and a seat support 16. The back 14 and seat support 16 are movable from the upright, seating position shown in FIG. 1 to a horizontal, sleeping position in which the back 14 is horizontally aligned with the seat support 16.

As can be seen in FIG. 1, when the frame of the convertible furniture 10 is in the upright, seating position, the mattress 18 acts as both the seat and back cushion. Likewise, when the frame of the convertible furniture 10 is moved to the horizontal, sleeping position, the mattress 18 lies flat and acts as a cushion for a person to sleep upon.

As discussed previously, conventional convertible furniture mattresses are typically formed from layers of fiber batting and a convoluted foam core. A problem arises that, over time, the fiber batting migrates or is forced into the spaces between peaks of the convoluted foam due to the weight of the mattress user.

In accordance with the present invention, the mattress includes a flexible, foraminous separation layer interposed or sandwiched between each fiber batting layer and each convoluted foam layer. Use of the separation layer serves to prevent the intrusion of the batting into the convoluted foam core so that the mattress maintains its optimal cushioning qualities.

Figure 2:
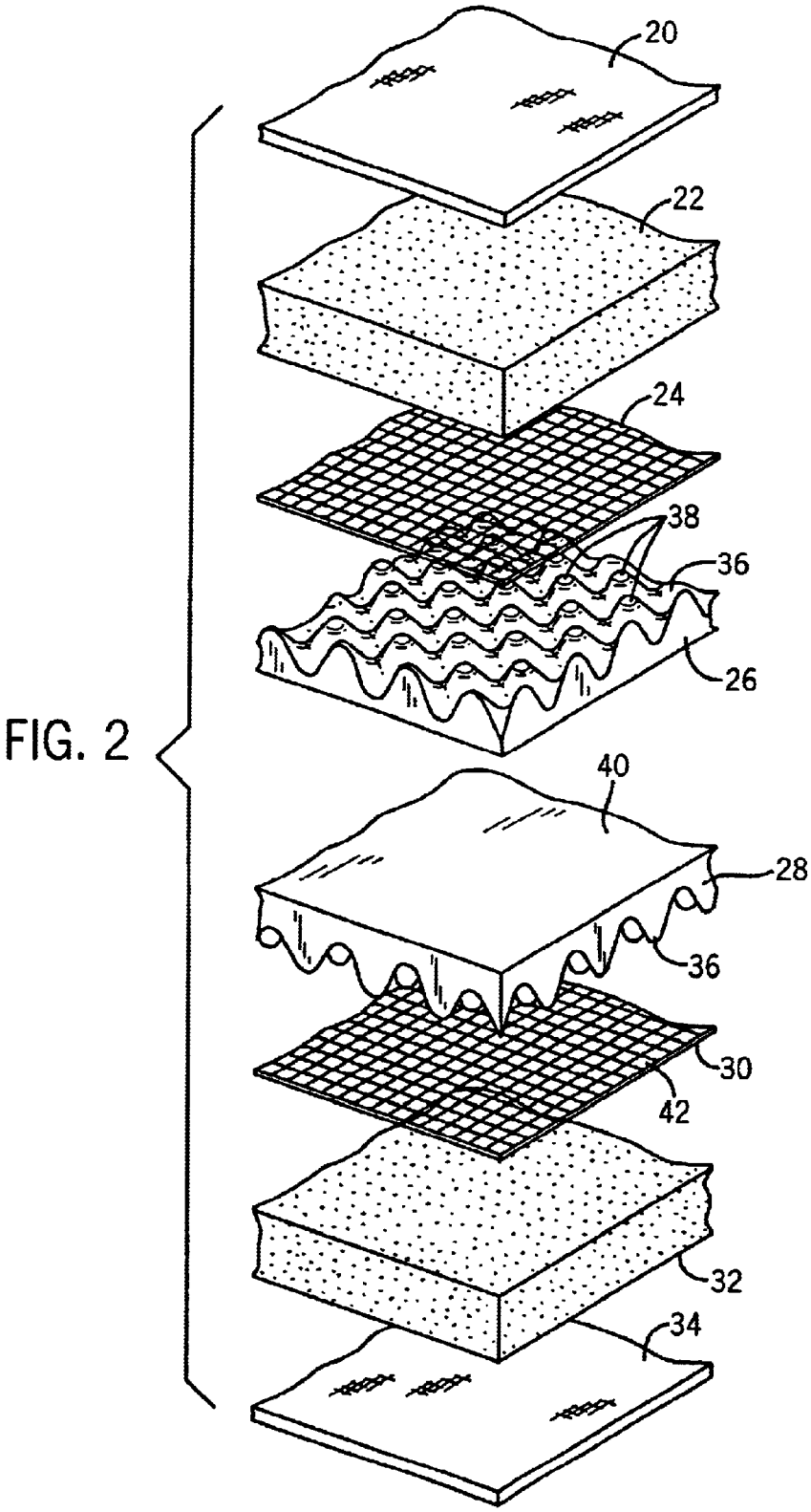
FIG. 2 is a fragmentary, exploded view of the components of the mattress in a disassembled state, including separation layers for maintaining the spacing of the cushioning components.

Referring now to FIG. 2, the mattress 18 is comprised of an upper protective, decorative fabric material 20, an upper fiber batting layer 22, an upper separation layer 24, an upper convoluted foam layer 26, a lower convoluted foam layer 28, a lower separation layer 30, a lower fiber batting layer 32 and a lower protective, decorative fabric material 34.

FIG. 3 shows the aforelisted components of the mattress 18 disposed one on top each other, the fiber batting layers 22, 32, the separation layers 24, 30, and the convoluted foam layers 26, 28 being encased in a sleeve like "tick" formed by the decorative fabric materials 20, 34 which are tufted together. Mattress 18 has a convoluted foam core defined by the upper and lower convoluted foam layers 26, 28, respectively. Each layer 26, 28 is identical and includes one side 36 formed with a series of spaced apart foam peaks 38 and an opposite side 40 which has a continuous flat surface. The flat surfaces 40 of the convoluted foam layers 26, 28 are interfaced together. The fiber batting layers 22, 32 are typically fabricated from cotton or wool material.

A distinctive feature of the mattress 18 is the separation layer 24 or 30 which lies between the layers of fiber batting 22, 32 and the convoluted foam layers 26, 28. Each separation layer 24 or 30 is preferably formed of a flexible, foraminous material, such as polypropylene mesh or netting, which effectively maintains the integrity of the convoluted foam layers 26, 28 so that they can continue to support various weights of users and retain resiliency. The invention contemplates that the size of the holes 42 in the netting 24 or 30 can be adjusted to create different feels in the mattress 18.

Testing was performed on a mattress construction as shown in FIGS. 3 and 4 without the netting 24, 30 and with the netting. In each case, a six-sided 36 inch wide roller weighing 230 pounds was rolled over the upper protective, decorative fabric material 20 for 100,000 cycles, wherein each cycle includes moving the roller over the longitudinal center line of the mattress (36 inches total rolled area). This type of testing is meant to simulate real-life usage of the mattress. Height readings of the mattress 18 were taken before and after the roller test. The visual set data obtained from the testing resulted in a pre-test mattress height, a post-test mattress height, a set measurement defined by the difference in pre-test and post-test heights and a percentage set calculated by dividing the set measurement by the pre-test mattress height.

Figure 5:
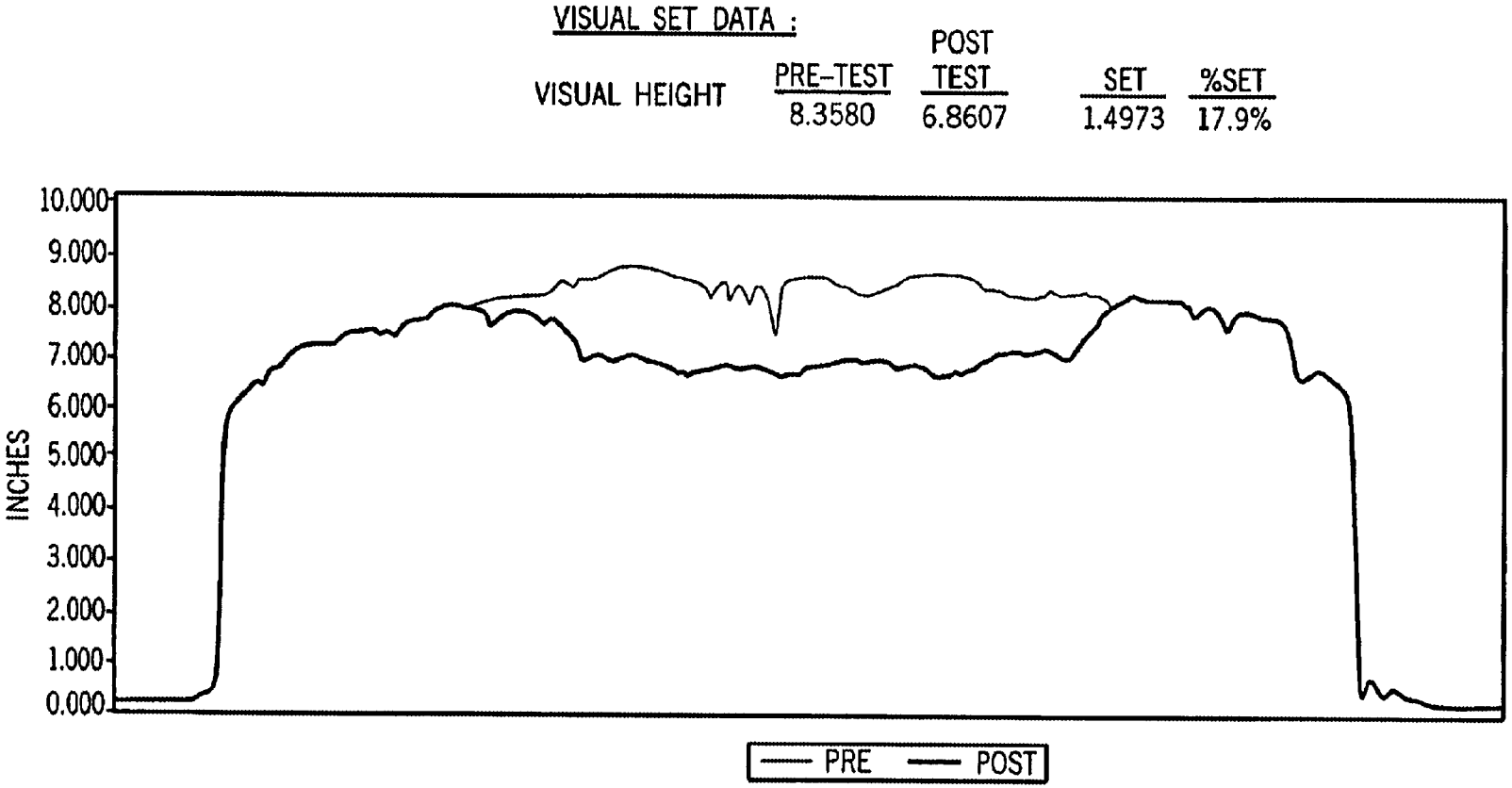
FIG. 5 is a graphical representation of a mattress having a construction without the separation layers.

FIG. 5 shows a visual set profile for a layered mattress construction similar to FIGS. 3 and 4 but without the netting 24, 30. The lighter line in the profile indicates the pre-test mattress height, and the darker line indicates the post-test mattress height. Without the netting 24, 30, the batting layers 22, 32 migrate into the convoluted foam layers 26, 28 causing appreciable sag measured by a 17.9 percent set.

Figure 6:
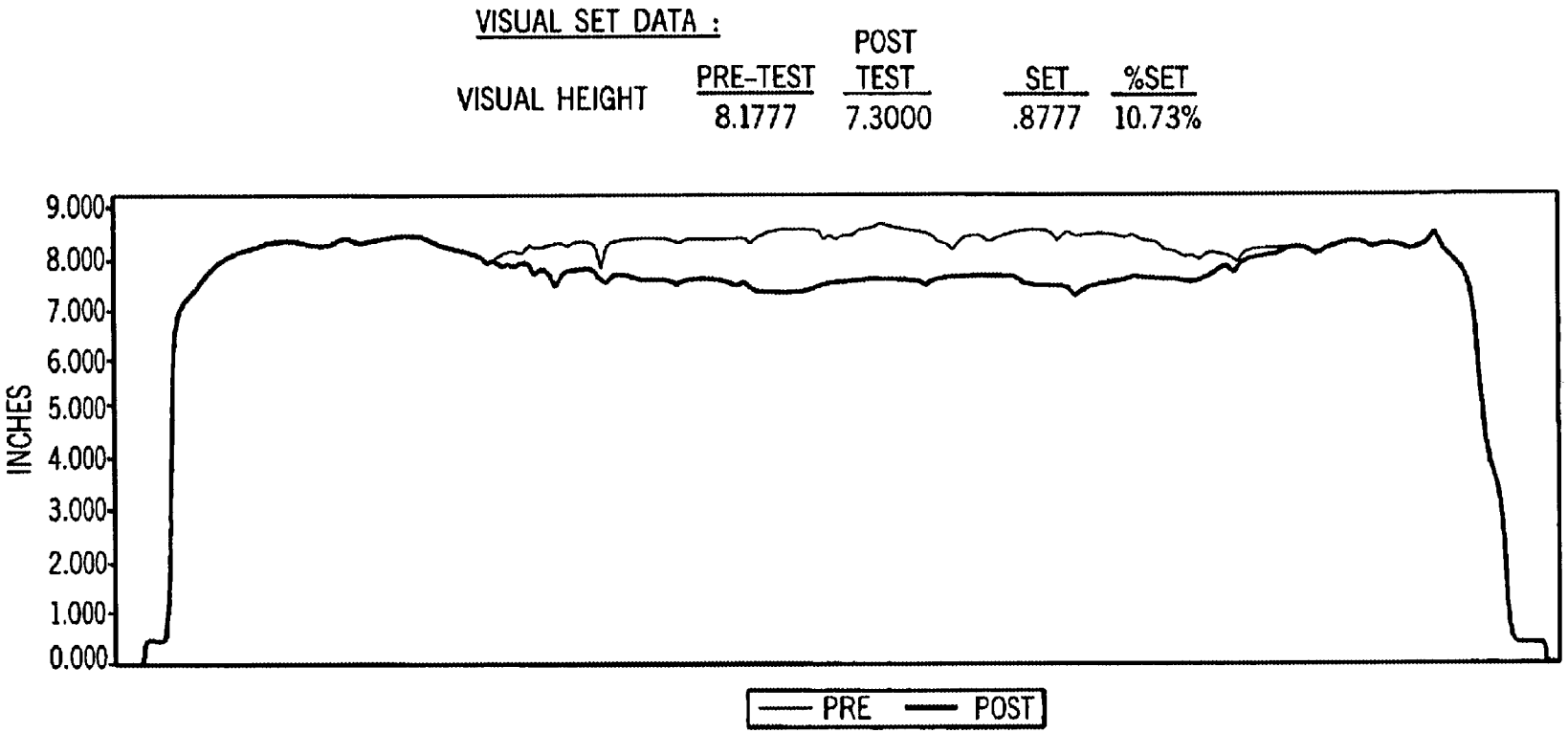
FIG. 6 is a graphical representation of a mattress construction including the separation layers.

FIG. 6 shows a visual set profile for a layered mattress construction similar to FIGS. 3 and 4 with the netting 24, 30. As can be seen from the profile, the degree of sag is markedly reduced relative to the mattress construction without the netting 24, 30. With the netting, 24, 30 maintaining separation of the batting layers 22, 32 from the convoluted foam layers 26, 28, the sag is calculated at a 10.7 percent set; that is, there is an approximate improvement of 40 percent in performance over the mattress 18 without the netting 24, 30. The mattress 18 with the netting 24, 30 thus has a greater retained loft, greater retained resiliency and resists body impression over a greater period of time.

While the invention has been described with reference to a preferred embodiment, those skilled in the art will appreciate that certain substitutions, alterations and omissions may be made without departing from the spirit thereof. Accordingly, the foregoing description is meant to be exemplary only, and it should not be deemed limitative on the scope of the invention as set forth with the following claims.

I claim:

1. A futon mattress comprising:

a first support component formed from fiber batting;

a second support component formed from convoluted foam;

a separation layer interposed between the first support component and the second support component for preventing the migration of the fiber batting into the convoluted foam, wherein the separation layer is comprised of a flexible, foraminous material.

2. A futon mattress comprising:

a first support component formed from fiber batting;

a second support component formed from convoluted foam;

a separation layer interposed between the first support component and the second support component for preventing the migration of the fiber batting into the convoluted foam, wherein the separation layer is comprised of a netting material.

3. The futon mattress of claim 2, wherein the fiber batting component includes a protective, decorative fabric material on an external surface thereof.

4. The futon mattress of claim 2, wherein the netting material is made of polypropylene.

5. A futon mattress comprising:

an upper protective, decorative fabric material;

an upper fiber batting layer disposed adjacent to the upper protective, decorative fabric material;

an upper flexible, netting material disposed adjacent to the upper fiber batting layer;

an upper convoluted foam layer disposed adjacent to the upper netting material;

a lower convoluted foam layer disposed adjacent the upper convoluted foam layer;

a lower flexible netting material disposed adjacent to the lower convoluted foam layer;

a lower fiber batting layer disposed adjacent to the lower netting material; and a lower protective, decorative fabric material disposed adjacent to the lower fiber batting layer, whereby the layers of netting material prevent the migration of the fiber batting layers into the convoluted foam layers, thereby optimizing the ability of the convoluted foam layers to be supportive and resilient.

6. The futon mattress of claim 5, wherein the fiber batting layers, the netting material and the convoluted foam layers are encased in a sleeve formed by the protective, decorative fabric materials.

7. The futon mattress of claim 5, wherein the netting material is made of polypropylene.

* * * * *